US006613982B1

(12) United States Patent
Kaland et al.

(10) Patent No.: US 6,613,982 B1
(45) Date of Patent: Sep. 2, 2003

(54) CABLE PROTECTION IN BLOW-OUT PREVENTERS

(75) Inventors: Frode Kaland, Stavanger (NO); Gisle Vold, Sandnes (NO)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/089,980

(22) PCT Filed: Oct. 5, 2000

(86) PCT No.: PCT/NO00/00330

§ 371 (c)(1),
(2), (4) Date: Sep. 27, 2002

(87) PCT Pub. No.: WO01/25590

PCT Pub. Date: Apr. 12, 2001

(30) Foreign Application Priority Data

Oct. 6, 1999 (NO) ..... 19994854

(51) Int. Cl.[7] ..... H02G 15/02
(52) U.S. Cl. ..... 174/74 A; 174/136
(58) Field of Search ..... 174/136, 74 A, 174/74 R, 95, 72 R, 47; 285/24, 119; 248/49; 166/241.1, 175, 176

(56) References Cited

U.S. PATENT DOCUMENTS

| | | | | |
|---|---|---|---|---|
| 2,858,093 | A | 10/1958 | Knoll | 248/49 |
| 4,004,326 | A | 1/1977 | Beavers | 24/81 CC |
| 4,337,969 | A | 7/1982 | Escaron et al. | 285/24 |
| 5,973,270 | A | 10/1999 | Keller | 174/136 |

OTHER PUBLICATIONS

International Search Report dated Apr. 20, 2001, for application serial No. PCT/NO00/00330.

*Primary Examiner*—Chau N. Nguyen
(74) *Attorney, Agent, or Firm*—Moser, Patterson & Sheridan, L.L.P.

(57) ABSTRACT

A production string with flexible electrical and/or hydraulic cables extending along therewith is lowered into a well through a blow-out preventer on the seabed and is formed by screwing together pipe lengths. The blow-out preventer having an enveloping pipe ram with an elastic valve element which, when pressurized, expands to envelope the production string at a preselected point. A core pipe is spliced into the production string at a preselected depth by way of threaded connections at its ends. A protective sleeve for the cables is attached to and around the core pipe, forming an annular space through which link pipes extend between end elements. The outlet ends of the link pipes have pressure couplings or blind plugs in unused holes. Support rings prevent the collapse of the protective sleeve under pressure.

4 Claims, 5 Drawing Sheets

CABLE PROTECTION IN BLOW-OUT PREVENTERS

BACKGROUND OF THE INVENTION

The present invention relates to cable protection assemblies for flexible cables which extend along a production string in undersea oil wells and the like.

The completion of an oil well is typically carried out by lowering a production tube to a blow-out preventer located on the seabed, and on down through the blow-out preventer to the reservoir. The blow-out preventer includes, among other things, several pipe rams with elastic valve elements. Consecutive lengths of production tube, screwed together to form a well path, are lowered vertically down through the blow-out preventer. At annular space is thereby produced between the production tube and the valve element. Flexible electrical and hydraulic cables extend longitudinally along the side of the production tube and down to connected tools or measuring instruments down in the well (which may be a production, injection or observation well).

It is generally necessary to attach the cables to the production tube. In principle, this can be done by simple straps or ties spaced at suitable intervals along the production tube. However, it may be desirable to provide more complicated attachment means. Thus U.S. Pat. No. 2,858,093 (Knoll/Maihak AG) describes a protective device or clip consisting of a cap which covers an exposed portion of the cable where the cable passes over an enlargement such as a joint in the pipe string; the device is secured by clamps to the pipe string. U.S. Pat. No. 4,004,326 (Beavers/Borg Warner) describes a sleeve divided longitudinally into two parts which are screwed around a pipe string; in one of the sleeve's outer walls there is a recess in which the cable is securely clamped. U.S. Pat. No. 5,667,009 (Moore) concerns the insulation of live cables when they are passed through a wellhead.

During procedures such as pressure testing of the annular space, the valve element in the pipe ram is pressurized with the result that it is expanded, enveloping the production tube, and only when the production tube is completely enveloped can pressure testing be performed. There is therefore a risk of compression damage to the cableways passing alongside the production tube. The cable attachments described above either do not provide protection for the cables or prevent the valve element from forming a pressure-tight seal against the production tube.

SUMMARY OF THE INVENTION

The object of the invention is to provide a means for effectively protecting cables on a production pipe during such pressure testing.

According to the invention there is provided a cable protection assembly for flexible electrical and/or hydraulic cables which extend along a production string which communicates with a well through a blow-out preventer located on the seabed, the blow-out preventer including a pipe ram with an elastic valve element which, when pressurized, expands to envelop the production string, characterized in that the protection assembly comprises:

- a core pipe with a threaded connection at each end for connection in the production pipe,
- a sleeve around the core pipe and having upper and lower end closure elements welded to the core pipe, each end closure element including at least one cable hole having a pressure-tight coupling for coupling to a cable, and
- at least one link pipe extending through the longitudinal annular space formed between the core pipe and the protective sleeve and connecting a pair of cable holes, one in each end element.

In the preferred arrangement, a sleeve-shaped body envelops an allotted length of a core tube or pipe which is connected in and forms part of the production tube, so producing a longitudinal annulus in the area in which pressure testing requires to be conducted. This annulus is closed in a pressure-tight manner by means of end elements with associated supporting and protective brackets. Several link pipe connections are passed as required through this annulus extending between the two end elements. Connecting passages are provided through the end elements with the link pipes connected to them from inside the annulus and such that hydraulic cables can be connected to them and electrical cables can be passed through them, in a pressure-tight manner in both cases. In order to prevent collapse of the sleeve-shaped body when it is exposed to mechanical forces from the pipe ram's valve element, a number of support rings are mounted inside it, with a corresponding number of holes corresponding to the said pipe connections. The longitudinal cable connections through the link pipes are thereby secured against compression damage.

A blow-out preventer including a protective sleeve in accordance with the invention will now be described, by way of example, with reference to the drawings, in which:

DETAILED DESCRIPTION OF THE INVENTION

Figure 1:
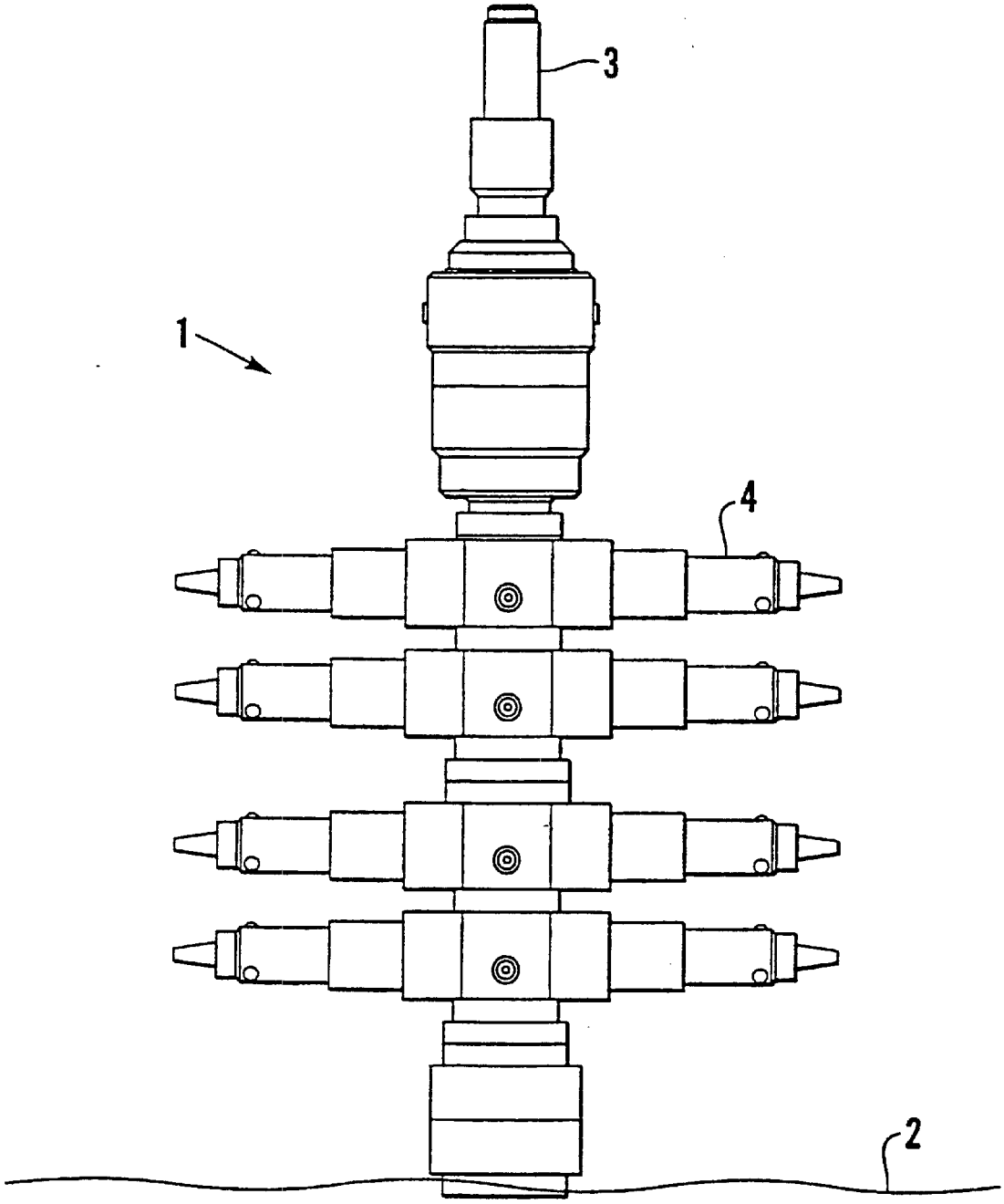
FIGS. 1 and 2 show a blow-out preventer.

FIG. 1 shows a blow-out preventer 1 which is located on the seabed 2 under an envisaged movable drilling rig. The blow-out preventer 1 has hydraulic communication to the surface vessel (the rig) through a riser 3. The actual blow-out preventer 1 includes, amongst other things, several pipe rams 4.

Figure 2:
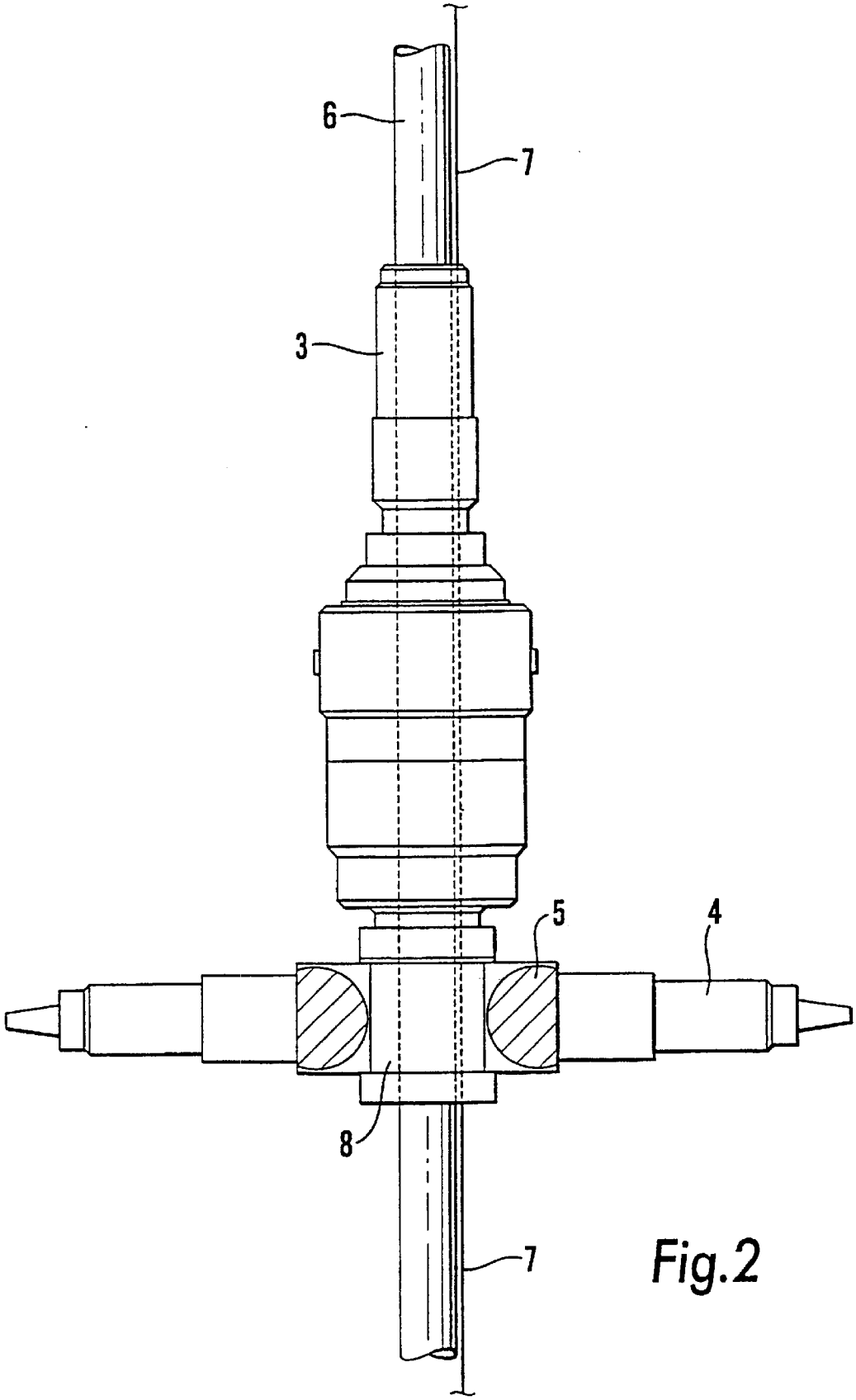

FIG. 2 shows a partial section of the blow-out preventer 1, with a pipe ram 4 and its elastic valve element 5. A production tube 6 is lowered through the blow-out preventer 1. This production tube has one or more longitudinal electrical or hydraulic cables 7 suspended along its side; these cables are connected to tools or measuring instruments down in the production, injection or observation well. The inside diameter of the valve element 5 is larger than the diameter of the production tube 6, resulting in an annular space 8 between the valve element 5 and the production tube 6.

Figure 3:
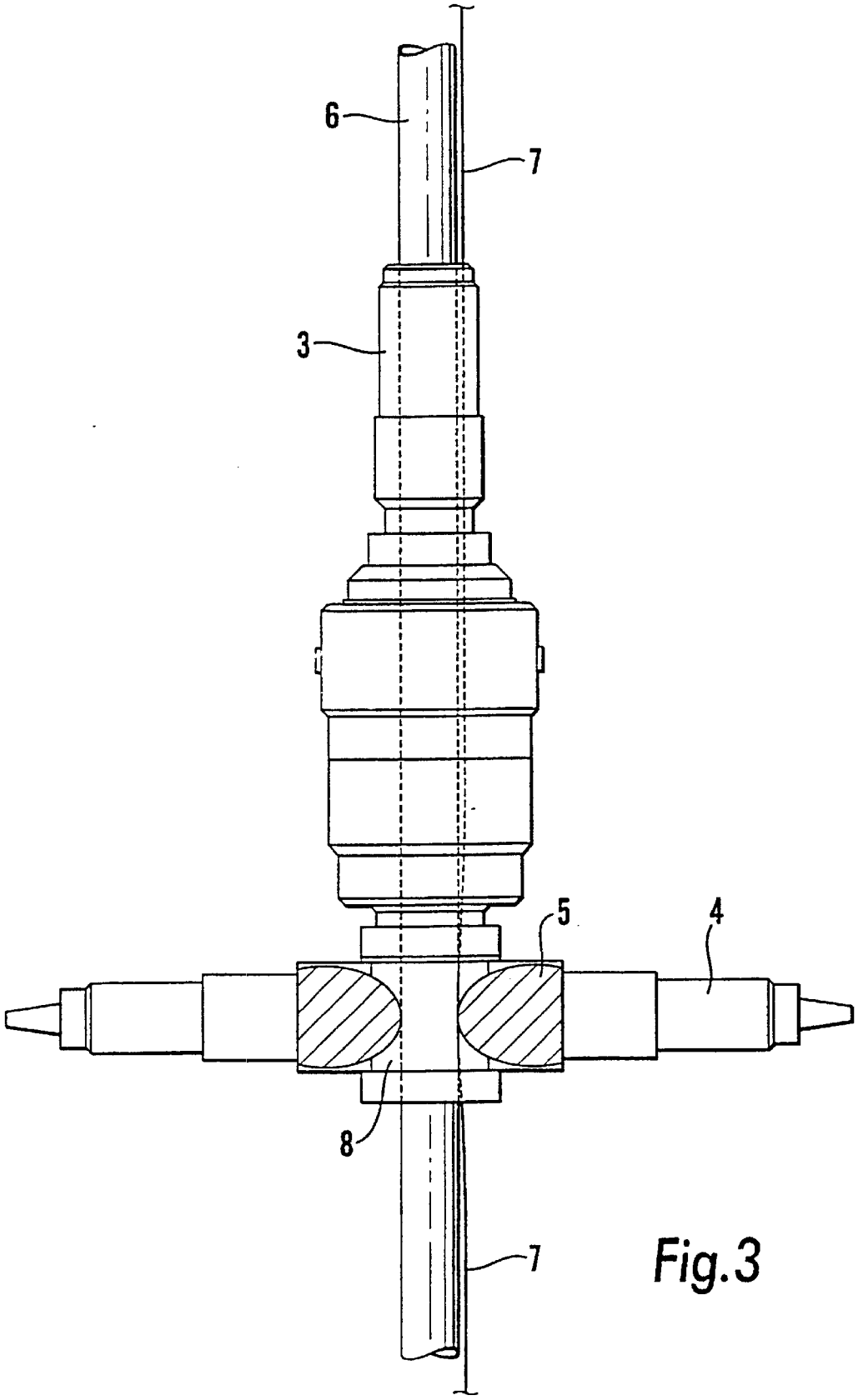
FIG. 3 shows a test situation.

FIG. 3 shows a typical testing situation. With the production string 6 lowered into the well with hydraulic or electrical cable 7 suspended on the side of this pipe, the pipe ram 4 is closed. This is done, for example, in order to pressure test the annular space 8 against the internal space of the production tube 6. The pipe ram 4 is closed around the production tube 6 by closing element 5 of the valve 4 being pressurized at its rear. This pressurising causes the valve element 5 to be expanded inwardly, enveloping the production tube 6. When the production tube 6 is completely enveloped by the shut-off element 5, pressure testing of, for example, the annular space 8 may be performed. After this pressure testing has been completed, the hydraulic pressure in the closing valve 4 is relieved, allowing the valve element 5 to withdraw completely to its starting position.

Figure 4:
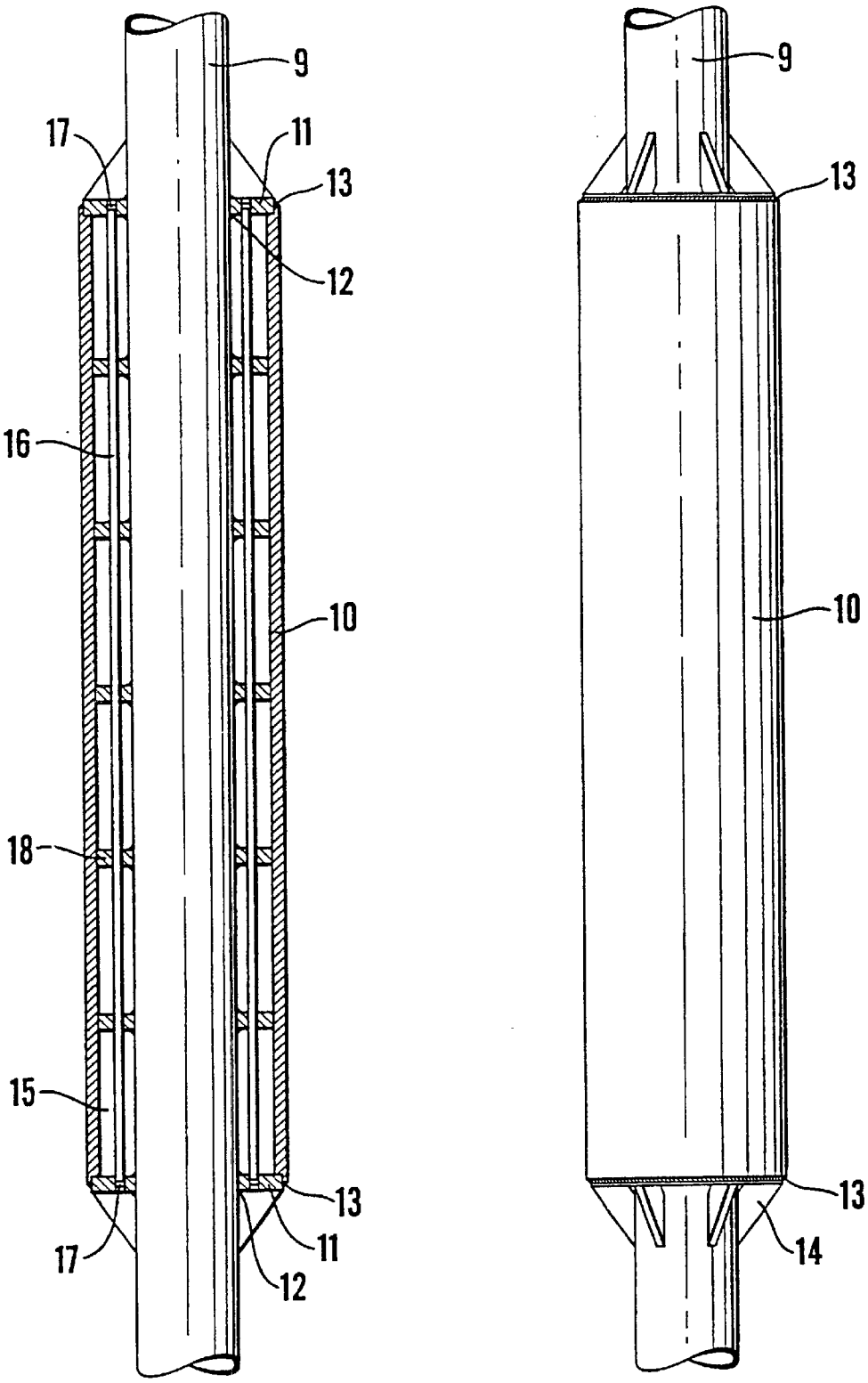
FIG. 4 shows, in section and side view, a protective sleeve.

FIG. 4 shows a protective sleeve 10 around a core pipe 9, which is effectively a length of production tube, which has a threaded connection at each end for joining it in the production string 6. By means of suitable end elements 11, the protective sleeve 10 is attached to the core pipe by, for example, welded connections 12, 13. There may be several supporting and protective brackets 14 attached to each of the end elements 11.

One or more smaller penetration or link pipes or tubes 16 are provided, passing through the annular space 15 formed by the core pipe 9 and the protective sleeve 10. These pipes are attached to cable holes in the end elements 11, 11. More specifically, at each end of the smaller pipes 16 there is a connection 17, which may for example be threaded, which permits a pressure-tight connection for passing on hydraulic or electrical cables through the smaller pipes 16. One or more support rings 18 may be mounted in the annular space 15 in order to prevent collapse of the outer pipe when it is exposed to horizontal mechanical forces, including those from the shut-off element 5 of the pipe ram 4.

Figure 5:
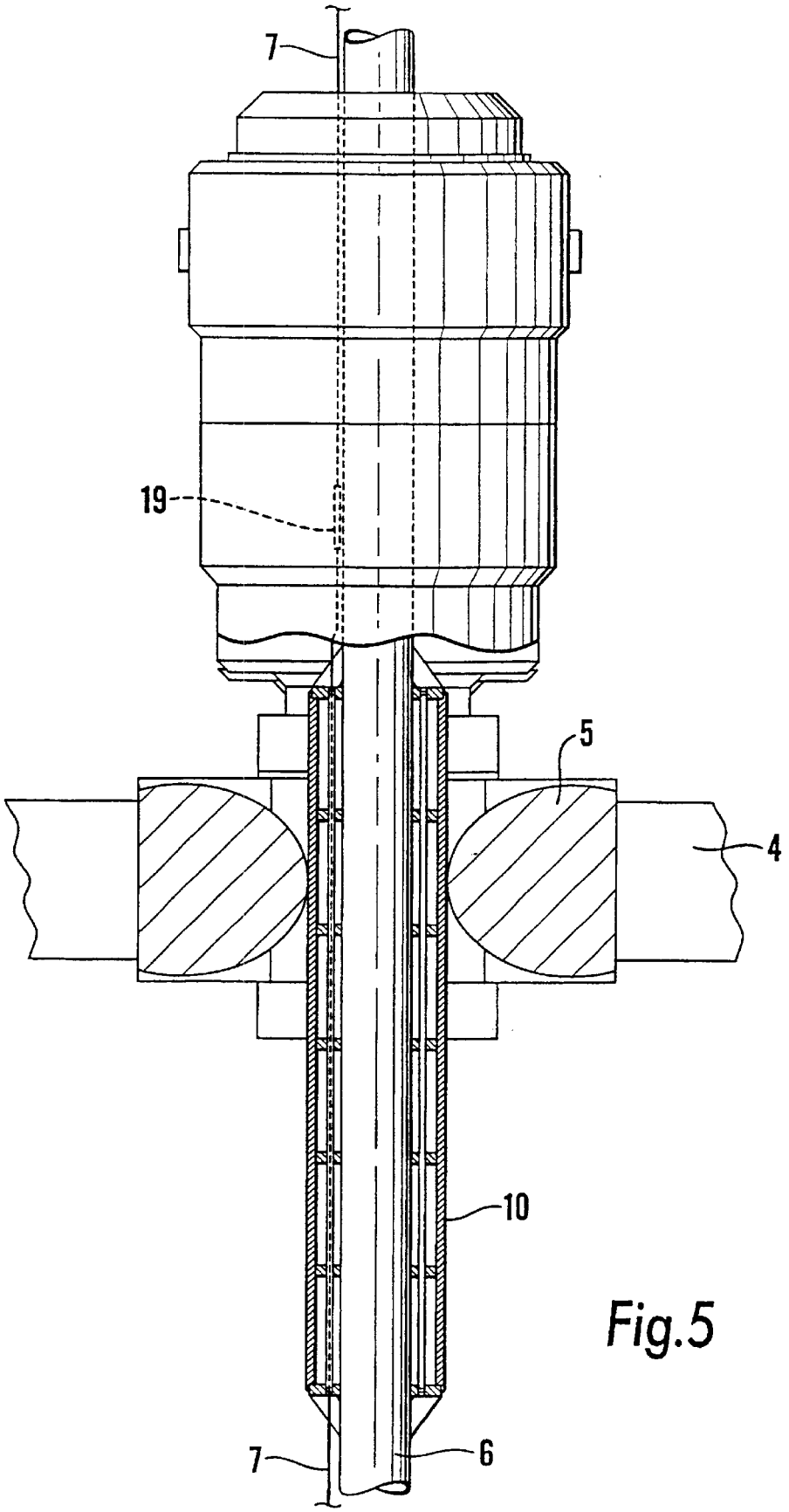
FIG. 5 shows the connections thereto.

FIG. 5 shows the protective sleeve 10 passed down over a blow-out preventer 1 where the pipe ram 4 is activated and the valve element 5 is pressing against the outside of the protective sleeve 10. Also shown is the electrical cable 7 which abuts against the production tube 6, and which is passed through one of the link pipes 16 of the protective sleeve 10. A coupling splice 19 of the cable is also shown above the protective sleeve 10.

A pressure test will therefore proceed as follows. Sensors and/or tools connected to the electrical and/or hydraulic cables 7 are mounted consecutively along production tube lengths 6 which are joined to form a production string. At a preselected point on the production string 6 the cable is cut from the drum while the protective sleeve 10 is mounted around the core pipe part 9. The cable end up from the well is passed along the production tube 6 through a standard union coupling 17 and on through one of the link pipes 16 in the protective sleeve 10. The union coupling is attached to the lower part of the link pipe 16 and subsequently to the actual cable 7.

A standard union coupling 17 is then passed over the cable end 7 which protrudes from the link pipe 16, whereupon the union coupling 17 is first attached to the upper end of the link pipe 16 and subsequently to the actual cable 7. Blind plugs are mounted in each of the unused cable holes in the end elements 11 of the sleeve 10. The cable end 7 which now protrudes from the link pipe 16 is joined to the remaining cable 7 on the drum. A new length of production tube 6 is then connected to the protective sleeve 10 with the core pipe part 9 mounted thereto. The constant connection of new lengths of production tube 6 in the well is followed by corresponding cable 7.

When the point is reached where the annular space has to be tested, the shut-off valve 4 is activated, so activating the valve element 5 around the outside of the protective sleeve 10. The fact that the cables 7 pass through respective link pipes 16 in the protective sleeve 10 protects the cables from being exposed to mechanical forces and consequent compression damage.

What is claimed is:

1. A cable protection assembly for flexible electrical and/or hydraulic cables (7) which extend along a production pipe (6) which communicates with a well through a blow-out preventer (1) located on the seabed (2), the blow-out preventer (1) including a pipe ram (4) with an elastic valve element (5) which, when pressurized, expands to envelop the production pipe (6), characterized in that the protection assembly comprises:

a core pipe (9) with a threaded connection at each end for connection in the production pipe, a protective sleeve (10) around the core pipe and having upper and lower end closure elements (11, 11) welded (12 and 13) to the core pipe (9), each end closure element including at least one cable hole having a pressure-tight coupling for coupling to a cable, and at least one link pipe (16) extending through the longitudinal annular space (15) formed between the core pipe (9) and the protective sleeve (10) and connecting a pair of said cable holes, one in each end element (11, 11).

2. A cable protection assembly according to claim 1, characterized in that the number of said at least one cable hole in each end closure element is greater than th number of said at least one pipe, and the unused holes are closed by blind plugs.

3. A cable protection assembly according to claim 1, characterized in that each of the end elements (11, 11) has radiating therefrom supporting and protective brackets (14) attached to the core pipe (9).

4. A cable protection assembly according to claim 1, characterized by at least one support ring (18) mounted in the annular space (15) to support the protective sleeve (10) against external pressure.

* * * * *